US010221508B2

(12) United States Patent
Lampaert et al.

(10) Patent No.: US 10,221,508 B2
(45) Date of Patent: Mar. 5, 2019

(54) DEVICE FOR CUTTING OFF A LENGTH OF WEFT YARN DURING WEAVING ON A WEAVING MACHINE AND A WEAVING MACHINE PROVIDED WITH SUCH A DEVICE

(71) Applicant: NV MICHEL VAN DE WIELE, Kortrijk/Marke (BE)

(72) Inventors: Vincent Lampaert, Vichte (BE); Brecht Halsberghe, Kuurne (BE)

(73) Assignee: NV MICHEL VAN DE WIELE, Kortrijk/Marke (BE)

( * ) Notice: Subject to any disclaimer, the term of this patent is extended or adjusted under 35 U.S.C. 154(b) by 252 days.

(21) Appl. No.: 15/032,048

(22) PCT Filed: Oct. 24, 2014

(86) PCT No.: PCT/IB2014/065588

§ 371 (c)(1),
(2) Date: Apr. 25, 2016

(87) PCT Pub. No.: WO2015/059670

PCT Pub. Date: Apr. 30, 2015

(65) Prior Publication Data

US 2016/0265145 A1 Sep. 15, 2016

(30) Foreign Application Priority Data

Oct. 24, 2013 (BE) ..... 2013/0718

(51) Int. Cl.
*D03D 49/70* (2006.01)
*D03D 47/12* (2006.01)
*D03D 49/28* (2006.01)

(52) U.S. Cl.
CPC ..... *D03D 49/70* (2013.01); *D03D 47/125* (2013.01); *D03D 49/28* (2013.01)

(58) Field of Classification Search
CPC ..... D03D 49/70; D03D 47/125; D03D 49/28
See application file for complete search history.

(56) References Cited

U.S. PATENT DOCUMENTS 6,155,309 A * 12/2000 Berktold ..... D03D 47/125 139/302
6,273,150 B1 * 8/2001 Shaw ..... D03D 49/70 139/435.1

FOREIGN PATENT DOCUMENTS

EP 0129812 A2 1/1985
EP 0953664 A1 11/1999

OTHER PUBLICATIONS

International Search Report dated Sep. 4, 2015.

* cited by examiner

*Primary Examiner* — Andrew W Sutton
(74) *Attorney, Agent, or Firm* — Symbus Law Group, LLC; Clifford D. Hyra

(57) ABSTRACT

A device for cutting off weft yarn (27) during successive weaving cycles, comprising a cutting element (1) and a rotatable detaining element (2*c*), (13) which is forced to a detaining position by a spring force in order to detain the yarn and can rotate, under the influence of a tensile force exerted by a rapier on the detained yarn, counter to the spring force to a non-detaining position in which the yarn can be moved further towards the cutting element (1) in order to be cut. Such a device is efficient and can be made to be more reliable and more compact than existing devices. The invention also relates to a weaving loom provided with such a device.

19 Claims, 5 Drawing Sheets

DEVICE FOR CUTTING OFF A LENGTH OF WEFT YARN DURING WEAVING ON A WEAVING MACHINE AND A WEAVING MACHINE PROVIDED WITH SUCH A DEVICE

This application claims the benefit of Belgian Patent Application No. BE-2013/0718, filed Oct. 24, 2013, which is hereby incorporated by reference in its entirety.

FIELD OF THE INVENTION

The present invention relates to a device for cutting off a length of weft yarn inserted between warp threads during successive weaving cycles, comprising a cutting element to cut the yarn and detaining means to detain the yarn during its movement towards the cutting element until the yarn is allowed to pass through in the direction of the cutting element as a result of a tensile force which is applied thereto.

BACKGROUND

During weaving on a weaving loom, a shed is in each case formed between warp threads during successive weaving cycles and one or more weft threads are inserted between these warp threads by a respective weft-insertion device, following which the newly inserted yarn is beaten up against the previous weft thread in the fabric being produced. Each weft-insertion device comprises for example a pair of cooperating rapiers consisting of a giver rapier and a taker rapier which, in each weaving cycle, first simultaneously move towards each other from a respective side of the weaving loom in the shed until they meet and then perform a return movement until they have withdrawn from the shed. In this case, the giver rapier inserts the end of the weft yarn from one side into the shed so that it can be transferred to the taker rapier in the shed and this taker rapier then takes the yarn end to the other side, so that a length of the weft yarn eventually stretches from one side to the other side through the shed.

Each giver rapier comprises means to hold the yarn so that it is carried along during the rapier movements. These may be, for example, clamping means or a catch space or a slot or a combination of one or more such means, generally denoted by the term catch means.

After such a yarn insertion, the inserted yarn is still connected to the yarn stock and the inserted length of yarn has to be cut from the weft yarn stock before the next yarn can be inserted. Furthermore, the free end of the weft yarn also has to be inserted correctly in said catch means of the rapier, so that the weft yarn is ready to be inserted in the shed during a subsequent weaving cycle.

It is known to provide a rapier weaving loom for weaving flat fabrics with a device for detaining and cutting off weft yarn having the characteristics described in the first paragraph of this description. More particularly, the device consists of a fixed clamping surface and an elongate elastically deformable clamping body which is fixedly attached opposite the clamping surface. A weft yarn can be clamped between the clamping surface and the clamping body as a result of the resilient action of the clamping body.

This known arrangement is configured in such a way that when the giver rapier moves towards the fabric for a next yarn insertion, this rapier carries along the weft yarn to be cut which extends between the fabric edge and the yarn stock and positions it between the resilient clamping body and the clamping surface, so that it is clamped. Since the giver rapier meanwhile moves further towards the shed with respect to the clamped weft yarn, the yarn will be pulled into the catch means of the rapier. As a result of the rapier moving further along, an increasing tensile force is exerted on the clamped yarn, as a result of which the weft yarn is eventually pulled out of the clamp and is moved further by the giver rapier until it comes within range of the cutting device and is finally cut between the fabric edge and the rapier. The giver rapier now holds the end of the weft yarn in its catch means and is ready for a subsequent yarn insertion.

This device has the drawback that the length of the elastically deformable clamping body is relatively large, as a result of which it takes up a considerable amount of space on the weaving loom. Consequently, this device is not suitable for use on a double-face weaving loom with two or more rapier devices operating one above the other. After all, the device also has to be arranged as closely as possible to the fabric edge in order to prevent too much weft yarn from being lost in the thread ends which protrude at the fabric edge and which are subsequently removed as waste. In the limited intermediate space between rapiers operating one above the other, it is not possible to provide a space for this bulky device which limits the loss of yarn.

Another drawback is that the clamping force of such a resilient clamping body shows relatively significant variations, depending on the properties (e.g. the thickness) of the yarn, and cannot be controlled, or at least not accurately. As a result thereof, the tensile force at which the yarn will break free from the clamp varies. However, with a view to the reliability of this device, the yarn should always be released and cut at virtually the same tensile force.

Belgian patent BE 1014135A3 describes a device which automatically cuts weft threads and which then picks up the free thread ends on the fabric edge and presents them to two rapiers of a double-face weaving loom which operate one above the other. Picking up and presenting weft yarn by means of yarn clamps on rotatable presentation levers requires complex drives and control units.

SUMMARY

It is an object of the present invention to remedy the above-described drawbacks by providing an efficient, simple and compact device for detaining and cutting off weft yarn which, more particularly, does not require any drives or control units other than the drive and control unit for the blade, which can be made sufficiently compact to be accommodated on a weaving loom with rapiers operating one above the other at a location which limits the loss of yarn on the fabric edges, and with a detaining force (in other words, the tensile force at which the yarn is no longer detained by the detaining means) which is either independent from the yarn properties or can be controlled in a reliable and accurate manner using simple means in order to take the modified yarn properties into account.

This object is achieved by providing a device for cutting weft threads during weaving on a weaving loom, having the characteristics indicated in the first paragraph of this description and in which, according to the present invention, the detaining means comprise a rotatable detaining element which is forced to a detaining position on account of a spring force which is exerted by a spring element, in which the detaining element is provided to detain the yarn in its detaining position and, under the influence of a tensile force on the detained yarn, to rotate counter to said spring force to a non-detaining position in which the yarn can be moved further towards the cutting element in order to be cut.

The non-detaining position is a position of the detaining element which allows the yarn to be moved so that it is within reach of the cutting element. Consequently, a detaining position is every position in which this is not the case.

With regard to the terms detaining position and non-detaining position, it should be noted for the sake of clarity that this relates to, on the one hand, a series of positions of the detaining element within a first zone in which the yarn is not within reach of the blade, and that all positions within said first zone are referred to as detaining positions and, on the other hand, a series of positions of the detaining element within another, second zone in which the yarn is within reach of the blade and that all positions of the detaining element within said second zone are referred to as non-detaining positions.

If, according to the invention, a detaining element is to be placed in a detaining position and a non-detaining position, this consequently means that the detaining element is to be placed in one of the positions inside the first zone and in one of the positions inside the second zone respectively.

Such a cutting device can be designed much more compact than the existing devices. Due to the fact that the holding element itself does, after all, not necessarily have to have a resilient action, it can be designed much smaller than the clamping parts of the existing devices which have to be resilient. The spring element may also be small and may, for example, be a small coiled spring or a torsion spring. The spring force of such a small spring element can also be accurately controlled, for example by changing the elastic deformation of the spring element. This can be effected, for example, by means of an adjusting screw. Due to its compactness, this device is also much more suitable for positioning on a weaving loom with two or more rapier devices which work one above the other. This makes an arrangement in which the weft yarn is cut close to the fabric edge possible.

In a preferred embodiment, the detaining means comprise a fixed guide element having a guide surface for the yarn facing the detaining element, so that the yarn can be detained while being in contact with the guide surface and the rotatable detaining element.

Such detaining means can be achieved by very simple means and often do not require any drive or control unit. The guide surface is preferably a single-part surface.

In a very preferred embodiment, the detaining element is provided to prevent the movement of the yarn towards the cutting element without keeping the yarn clamped in.

Here, the detaining element does not act as clamping means, but only ensures that the weft yarn is detained and cannot be moved so far as to be within reach of the cutting means. This offers the advantage that the tensile force which has to be exerted on the weft yarn in order to rotate the detaining element to its non-detaining position is completely independent of the properties of the yarn, such as for example the thickness of the yarn. When the weaving loom, after weaving a certain fabric, is prepared to weave another fabric having a greatly differing weft yarn, it will usually therefore not be necessary to adjust the detaining means to this other weft yarn. Also if different types of weft yarns are inserted during the same weaving process, e.g. using a weft yarn selector, the device will be able to detain and cut each yarn type in an equally efficient way.

In a particularly preferred embodiment, the spring force exerted by the spring element is adjustable. It is for example possible to use a spring element which, in an elastically deformed state, is placed between, on one side, the detaining element and, on the other side, a positionable support element, so that a change in the position of the support element changes the elastic deformation of the spring element, and consequently also changes the spring force applied to the detaining element. The support element may, for example, be positioned by means of a screw which can be moved with respect to a fixed part of the device by means of a threaded connection. In its simplest form, the support element itself is configured as an adjusting screw.

In an efficient embodiment of this device, the detaining element comprises a yarn contact surface which faces away from the cutting device and substantially extends in a direction which forms an angle with the guide surface which is between 45° and 135° if the detaining element is in the detaining position.

In a particularly expedient embodiment, the device also comprises additional guide means for guiding the yarn to a limited contact zone of the detaining element. The tensile force which is exerted on the yarn and is required to cause the detaining element to rotate to its non-detaining position (the detaining force) not only depends on the spring force, but also on the distance between the point of rotation and the location where the yarn transmits the tensile force to the detaining element. Due to the fact that the additional guide means always guide the yarn to the same limited contact zone, the detaining force will vary even less.

As a result thereof, virtually only the spring force determines said detaining force. By purposeful selection of the spring element, it is possible to ensure that the required tensile force is sufficiently high to be able to detain the weft yarn until it has reached the catch means of the moving rapier. Obviously, care also has to be taken to ensure that this detaining force does not become excessively high in order to prevent yarn rupture or excessive force on the rapier. If the spring force is adjustable, an optimum detaining force can be set. As a good performance by the device depends virtually only on the spring force, a very reliable device is produced.

The detaining element may, for example, be configured as an elongate element which is forced to the detaining position by means of a torsion spring or may itself form part of a torsion spring. The elongate element may be a thin rod or a pin and may be elastically deformable. The torsion spring may be thread-like and comprise a coil-shaped wound part in which a thread-like non-wound end part of this torsion spring forms the elongate detaining element. Such a detaining element is particularly simple. Here, the same component has the function of a spring element as well as the function of a detaining element.

In a most preferred embodiment, the device comprises:

- a guide element of which a free surface forms said guide surface,
- an arm which extends opposite the guide element at an intermediate distance,
- a cutting element which is arranged in such a manner that a yarn can come into contact with the cutting element via the intermediate space between the guide element and the arm,
- a detaining element which is rotatably attached to the arm, so that it extends in the space between the arm and the guide element and prevents a yarn from passing to the cutting element, and
- a spring element which exerts a spring force on the detaining element and forces it to its detaining position, so that the detaining element, as a result of a tensile force on a yarn which is detained thereby, rotates in the direction of the cutting element in such a manner that the yarn is moved in the direction of the cutting element and comes into contact with the cutting element and is cut.

In an alternative embodiment according to the present invention, the detaining element comprises a clamping surface facing the guide surface, so that, in the detaining position, it can clamp the yarn between the clamping surface and the guide surface.

With this embodiment, the tensile force which is required to pull the clamped weft yarn loose depends on the yarn thickness. In order to achieve an optimum pulling force for the different yarn types, this embodiment is preferably configured in such a way that the clamping force is controllable.

Thus, it is possible to make the position of the detaining element with respect to the guide surface adjustable and/or to make the spring force exerted by the spring element adjustable in order to control the clamping force exerted on a yarn.

The clamping surface of the detaining element preferably forms part of or changes into a convex curved surface. This surface then forms a guide surface for gradually guiding the yarn to the clamping surface during movement of the former in the direction of the detaining means.

According to a particularly preferred embodiment, this device comprises:

- a guide element of which a free surface forms said guide surface,
- an arm which extends opposite the guide element at an intermediate distance,
- a cutting element which is arranged in such a manner that a yarn can come into contact with the cutting element via the intermediate space between the guide element and the arm,
- a rotatably attached detaining element with a clamping surface, so that the detaining element is substantially situated between the guide element and the arm with the clamping surface facing the guide surface, and
- a spring element which, on one side, acts on the arm and, on the other side, acts on the detaining element and pushes the detaining element towards the guide element to keep a yarn clamped between the guide surface and the clamping surface and thus to prevent the movement of said yarn towards the cutting element, in which a tensile force on the yarn clamped in this way can cause the detaining element to rotate away from the guide surface in such a manner that the yarn is released and is moved further to the cutting element and cut.

Said cutting element is preferably a rotatable circular blade.

In a particular embodiment, said cutting element is substantially covered by a covering wall or a housing on at least one side. This covering wall or housing preferably has a closed covering surface.

The present invention also relates to a weft-insertion device for a weaving loom, comprising at least one rapier which is provided to insert a weft thread in successive weaving cycles in a shed formed between warp threads, characterized in that said weft-insertion device comprises a device for detaining and cutting-off weft yarn according to the present invention.

This weft-insertion device is then preferably configured in such a manner that the rapier comprises pick-up means, such as for example a pick-up space provided in the rapier head in combination with clamping means, in order to carry along a weft yarn to the shed, that the rapier is provided to carry along a yarn which extends between the fabric edge and the weft yarn stock to the shed and take the yarn to the detaining means during this movement, so that the yarn is detained and hereby pulled into the catch means of the rapier which is moving along.

In this weft-insertion device, the rapier is preferably also provided and arranged such that the yarn detained by the detaining means is carried along during its movement to the shed, so that a tensile force is exerted on the detained yarn which causes the detaining element to rotate to a non-detaining position, as a result of which the yarn can be moved further towards the cutting element and comes into contact with the cutting element and is cut.

In a strongly preferred embodiment of this weft-insertion device, it comprises at least two rapiers which are provided to insert a weft thread in successive weaving cycles at respective weft-insertion levels in a shed between warp threads, and a device for detaining and cutting off weft yarn according to the present invention is provided for each rapier.

In a weft-insertion device with two rapiers, two devices for detaining and cutting off weft yarn are arranged one above the other. These devices are then preferably provided in a mirrored design, in which the two devices are one another's mirror image with respect to an imaginary horizontal mirror plane which extends between both devices.

The present invention also relates to a double-face weaving loom with such a weft-insertion device having at least two rapiers.

BRIEF DESCRIPTION OF THE DRAWINGS

Below, a detailed description of two embodiments of the cutting device according to the present is given in order to further explain the features of the invention. It will be clear that these are only examples of the many embodiments which are possible within the scope of the invention. This description can therefore by no means be seen as a limitation of the scope of protection, nor of the area of application of the invention.

In this detailed description, reference numerals are used to refer to the attached figures, in which.

DETAILED DESCRIPTION

A first particular embodiment of the device according to the invention is illustrated in FIGS. 1 to 4 and comprises a substantially cylindrical base body (A) which is provided with an electric motor for driving the blade. The base body carries a head portion (B) which comprises the components for detaining and cutting off weft yarn described below.

The head portion (B) comprises a flat wall (10) which runs at right angles to the longitudinal axis of the base body (A). A shaft (1*a*) runs through this wall (10) on which a circular blade (1) is fitted in a plane which runs parallel to the wall (10). This shaft (1*a*) may be driven by means of the electric motor in order to rotate the circular blade (1).

The flat wall (10) is a component which is formed in such a way that it forms a projecting arm (8) and also forms a tapering pointed portion (10*a*) which is at a certain intermediate distance from the arm (8) and has an inclined edge (11) directed towards the arm (8).

Figure 1:
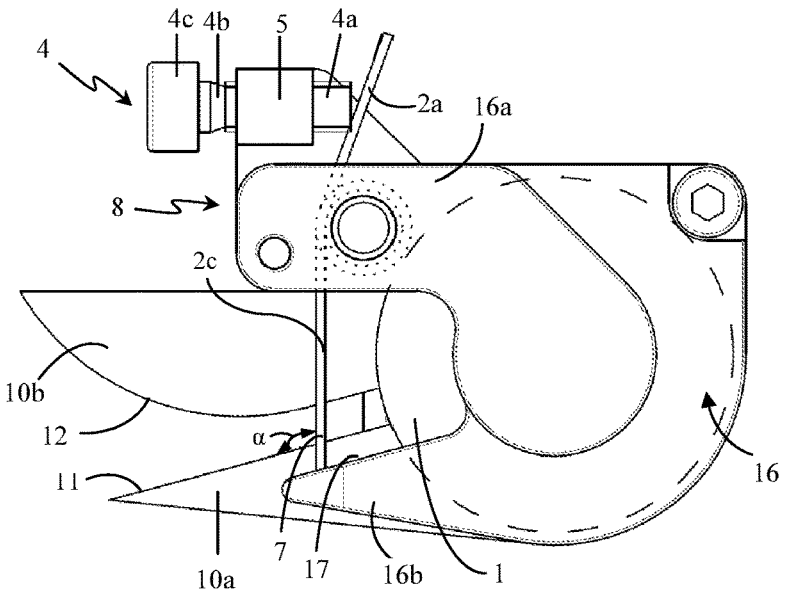
FIGS. 1, 2 and 3 show a side view and two different perspective views respectively, of a first embodiment of the device for detaining and cutting off weft yarn according to the present invention.
Figure 2:
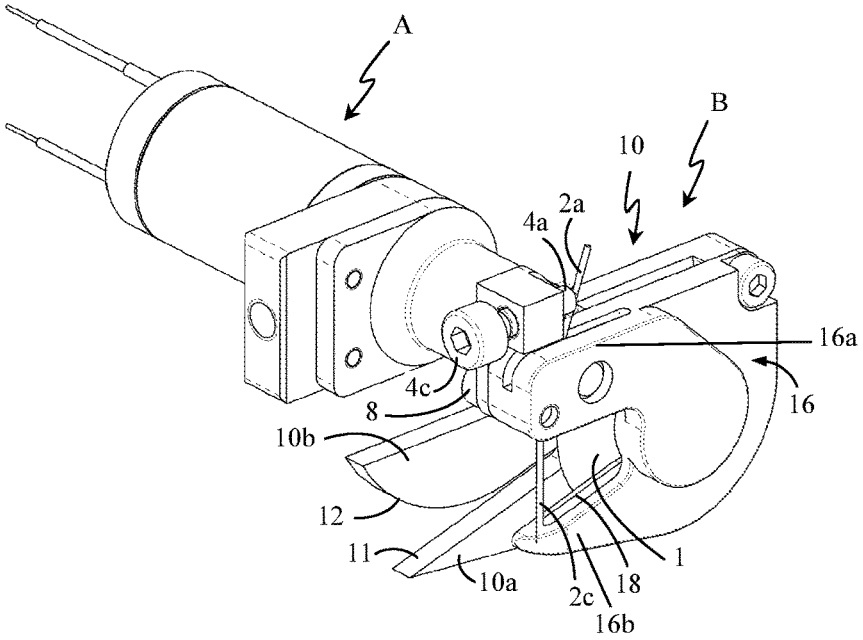
Figure 3:
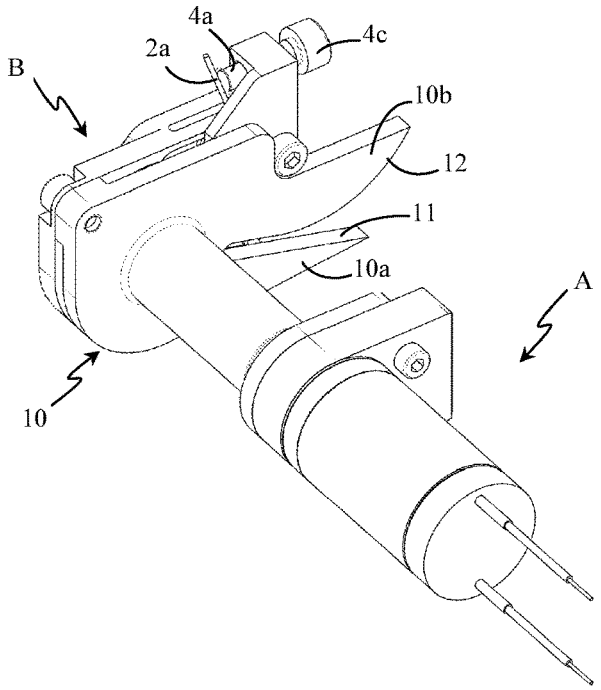
Figure 4:
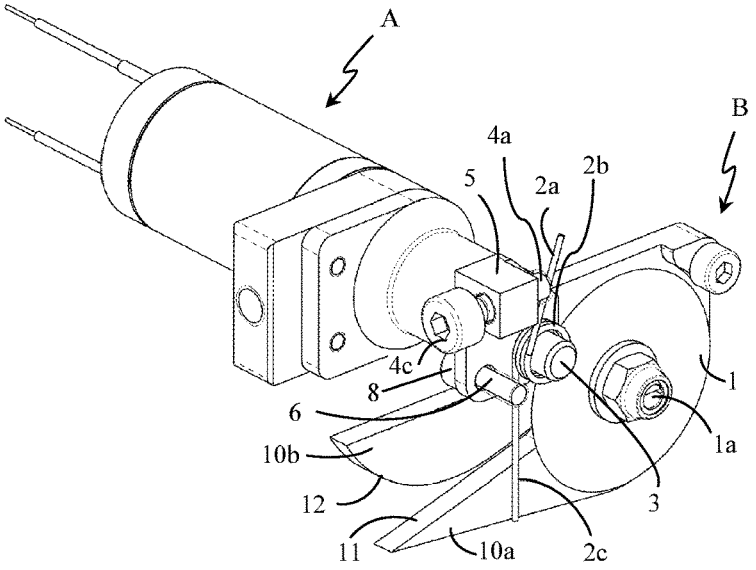
FIG. 4 shows a perspective view of this first embodiment, after removal of the housing on the side of the blade.
Figure 5:
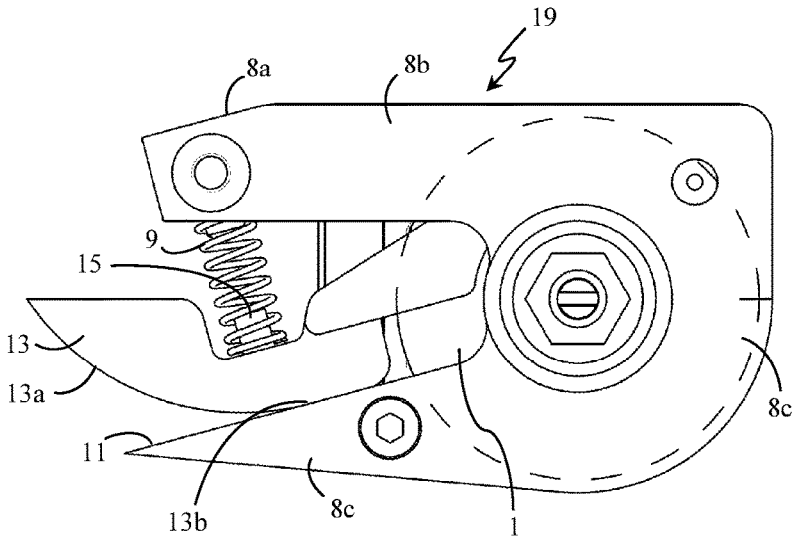
FIGS. 5, 6 and 7 show a side view and two different perspective views respectively, of a second embodiment of the device for detaining and cutting off weft yarn according to the present invention.
Figure 6:
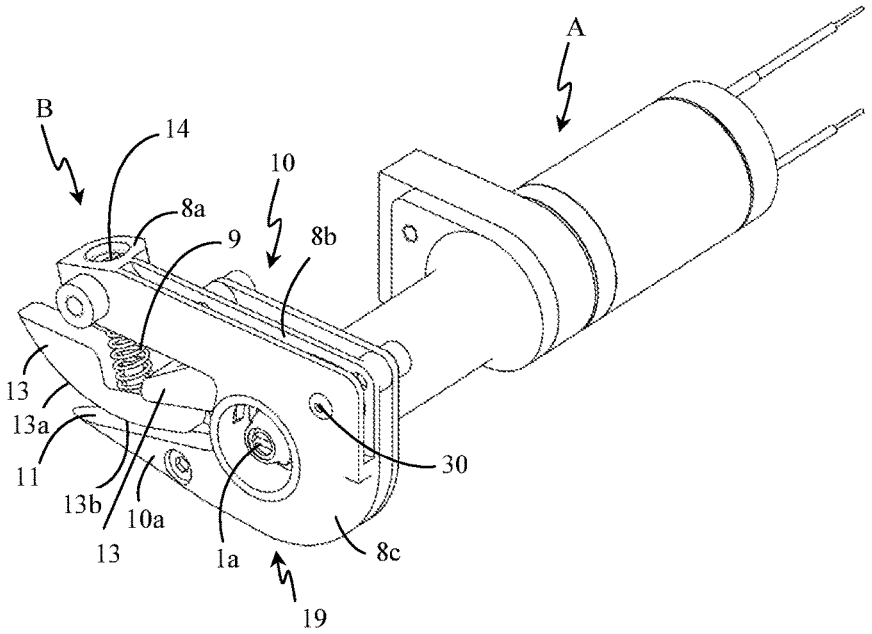
Figure 7:
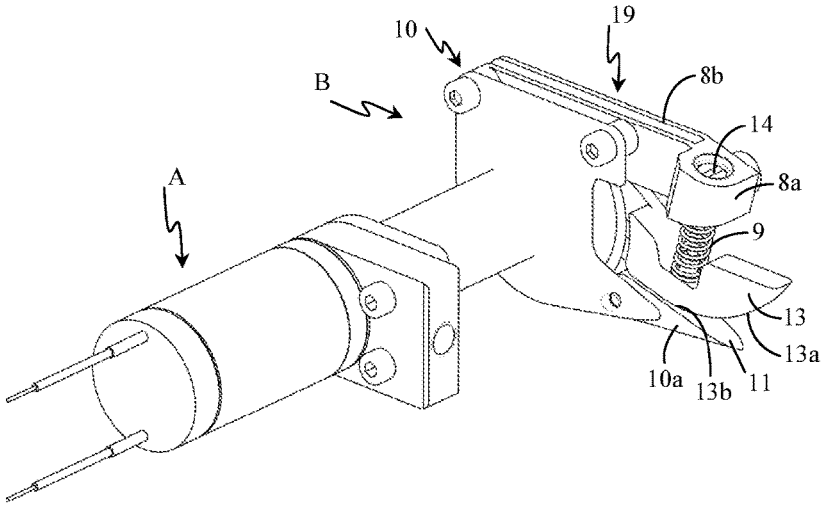

Attached to the arm (8) is a spring element (2) which is configured as a torsion spring. The spring element (2) consists of metal wire and is configured as a torsion spring with two straight end parts (2*a*), (2*c*) and a coil-shaped central part (2*b*). As can clearly be seen in FIG. 4, this central part (2*b*) is fitted to a cylindrical protrusion (3) which is provided on the arm (8). In this case, the coils are situated around said protrusion (3). In FIG. 4, the one straight end part (2*a*) of the spring element (2), hereafter referred to as the supporting part (2*a*), extends obliquely upwards and contacts the end of a shaft (4*a*) of a adjusting screw (4). A part of the screw shaft (4*a*) is provided with screw thread (4*b*) and is rotatable in a bore hole provided for the purpose in a block-shaped body (5) which is provided on said wall (10). By rotating the adjusting screw (4), e.g. using a tool which engages with the screw head (4*c*), the end of the screw shaft (4*b*) is moved, as a result of which the supporting part (2*a*) of the spring element (2) can gradually be moved. The other straight end part (2*c*) of the spring element (2) extends vertically downwards in FIG. 4 and is referred to below as the detaining part (2*c*), since this is the part which is provided to detain the weft yarn. The end of the detaining part (2*c*) is situated in a groove (18) which is provided in a covering wall (16) which is attached to the flat wall (10) and which will be described below. In order to position this covering wall (16) with respect to the flat wall (10), said flat wall (10) comprises, inter alia, a protruding pin (6).

The covering wall (16) extends alongside the circular blade (1), so that this is largely covered, and furthermore also covers the arm (8) and thus also the protrusion (3) on which the central part (2*b*) of the torsion spring is arranged. Obviously, slot-shaped openings are provided in order to allow said straight end parts (2*a*), (2*c*) of the torsion spring which extend upwards and downwards respectively, to pass through and give them sufficient freedom to move.

The covering wall (16) has a first protruding portion (16*a*) whose shape and size virtually correspond to the shape and size of the arm (8), and a second protruding portion (16*b*) which extends next to that portion (10*a*) of the flat wall (10) which tapers off to a point (see FIG. 2), and an inclined edge (17) which faces the first protruding portion (16*a*). A groove (18) is provided in this inclined edge (17). The intermediate distance between the first (16*a*) and the second protruding portion (16*b*) is such that the end of the detaining part (2*c*) of the torsion spring is situated in this groove (18).

With the device illustrated in FIG. 4, said covering wall (16) has been removed.

In its vertical position, the detaining part (2*c*) contacts the end of said groove (18). Due to the fact that the supporting part (2*a*) and the detaining part (2*c*) are retained by the adjusting screw (4) and the end of the groove (18) respectively, the spring element (2) can be fitted with a certain prestress (elastic deformation).

If forces are exerted on the detaining part (2*c*) in the direction of the circular blade (1), the detaining part (2*c*) is moved in this direction counter to a spring force. In this case, the detaining part (2*c*) carries out a rotating movement with respect to the cylindrical protrusion (3) in which the spiral-shaped central part (2*b*) of the spring element (2) is arranged. In the other direction, facing away from the circular blade (1), the detaining part (2*c*) is retained by the end of the groove.

By turning the adjusting screw (4), the prestress on the spring element (2) can be increased or decreased. In this way, the detaining force of the detaining part (2*c*) can be increased or decreased.

The abovementioned wall (10) also forms a tapering pointed portion (10*a*) with an inclined edge (11) which is situated opposite the arm (8) at a certain intermediate distance, so that there is an intermediate space between the inclined edge (11) and the arm (8), in which the yarn has to be moved through said intermediate space in order to come within range of the circular blade (1).

In this case, the inclined edge (11) forms a guide surface for the weft yarn when this yarn is moved in the direction of the circular blade (1) by the rapier. The detaining part (2*c*) of the spring element (2) extends vertically from the arm to the groove (18) and thereby prevents free passage to the circular blade (1). During its movement, the weft yarn will consequently be detained first by the detaining part (2*c*).

When the tensile force on the yarn exceeds a certain threshold (the detaining force), the detaining part (2*c*) will rotate, counter to the spring force, in the direction of the circular blade (1) with respect to the protrusion until it reaches a non-detaining position. As a result thereof, the weft yarn can be moved further until it comes into contact with the cutting edge of the circular blade (1) and is cut. Depending on the properties of the detaining part (2*c*) and the forces exerted thereon, the detaining part (2*c*) will possibly also be elastically bent. In this case, the yarn will not be allowed past the detaining part (2*c*). Due to the fact that this detaining part moves in a plane which is situated next to the plane of the circular blade (1), the rotation and possibly also bending of the detaining part (2*c*) is sufficient to permit the yarn to come into contact with the cutting edge of the circular blade (1).

Because the detaining force is affected by the location where the yarn transmits the tensile force onto the detaining part (2*c*), and because the aim is to vary this detaining force as little as possible during the weaving process, the yarn is guided to a limited contact zone (7) on the detaining part (2*c*) during its movement in the direction of the detaining part. To this end, the wall (10) also forms an additional protruding portion (10*b*) with a guide edge (12) for the yarn which is directed towards the inclined guide surface (11). As can most clearly be seen in FIG. 1, this guide edge (12) follows a convex curved path which approaches the inclined guide surface (11) in the direction of the detaining part (2*c*).

A second particular embodiment of the device according to the invention is illustrated in FIGS. 5 to 8 and also comprises a substantially cylindrical base body (A) with a head portion (B), just like the first embodiment.

The head portion (B) differs therefrom in that it comprises different parts for detaining weft yarn.

Just as in the first embodiment, the head portion (B) comprises a flat wall (10) which runs at right angles to the longitudinal axis of the base body (A), a shaft (1*a*) extends through this wall (10), to which shaft (1*a*) a circular blade (1) is attached in a plane which runs parallel to the wall, and this shaft (1*a*) may be driven by means of an electric motor fitted in the base body (A) in order to make the circular blade (1) rotate.

Here, the flat wall (10) also forms a tapering pointed portion (10*a*) with an inclined edge (11).

On the side facing away from the base body (A), a flank part (19) is attached to the flat plate (10) comprising an arm (8*b*) which extends at a certain intermediate distance opposite the inclined edge (11) of the tapering pointed portion (10*a*). The arm (8*b*) is inter alia composed of two parallel plates (see FIGS. 6 and 7). On the free end of the arm (8*b*), the flank part (19) comprises a holder (8*a*) which holds the end of a coiled spring (9). The other end of the coiled spring (9) is in contact with a rotatable clamping element (13). The holder (8*a*) comprises an set screw (14) which is accessible from the top and by means of which the position of the end of the coiled spring (9) can be changed in order to control the spring force exerted on the clamping element (13), as will be explained below.

Furthermore, the flank part (19) also comprises a covering wall (8*c*) which adjoins the arm (8*b*) and which extends both along the circular blade (1) and along the tapering pointed portion (10*a*). In this case, the covering wall (8*c*) completely covers the tapering pointed portion (10*a*) and largely covers the circular blade (1), with only a central portion of the blade (1) remaining uncovered. This is due to the fact that a circular opening is provided in the covering portion (8*c*) at the location of the shaft (1*a*) of the circular blade (1), the shaft (1*a*) being situated centrally with respect to the edges of said opening.

The tapering pointed portion (10*a*) of the flat wall (10) has an inclined edge (11) which is situated opposite the arm (8*b*) at a certain intermediate distance, so that there is an intermediate space between the inclined edge (11) and the arm (8*b*), in which the yarn has to be moved through said intermediate space in order to come within range of the circular blade.

In this case, the inclined surface (11) forms a guiding surface for the weft yarn when said yarn is moved in the direction of the circular blade (1) by the rapier.

A clamping element (13) is also attached to the wall (10). To this end, the clamping element comprises a portion which extends in the narrow space between said parallel plates of the arm (8*b*). A shaft (30) crosses the parallel plates and the portion of the clamping element (13) situated in between, so that this clamping element (13) is rotatable about this shaft (30) (see FIGS. 6 and 8). The clamping element (13) is situated in the intermediate space between the arm (8*b*) and the inclined surface (11). At its top, the clamping element (13) has a pin (15) on which the other end of the above-mentioned coiled spring (9) is fitted. On the side facing the inclined guide surface (11), the clamping element (13) has a convex curved edge part (13*a*) which transitions into a portion (13*b*) which runs parallel to the guide edge and forms a clamping surface, so that a weft yarn can be clamped between this clamping surface (13*b*) and the inclined guide surface (11). The convex curved edge part (13*a*) approaches the inclined guide surface (11) in the direction of the circular blade (1).

When the weft yarn is moved towards the circular blade, the convex curved part (13*a*) of the edge of the clamping element (13) will guide this yarn until it is between the clamping surface (13*b*) and the inclined guide surface (11).

During its movement, the weft yarn will consequently first be clamped between the clamping surface (13*b*) of the clamping element and the guide surface (11). The clamping force can be accurately controlled by means of the above-mentioned set screw (14). By turning the set screw (14), the spring end is moved, as a result of which the prestress (the elastic deformation) of the spring (9) which is situated between the holder (8*a*) and the clamping element (13) is changed, and consequently also the clamping force on a yarn which is clamped between the clamping element (13) and the guide surface (11).

If the tensile force on the yarn exceeds a certain threshold (the detaining force), the clamping element (13) will rotate, counter to the spring force, over a small distance in the direction of the arm (8*b*) until it reaches a non-detaining position. As a result thereof, the weft yarn will be unclamped, making it possible to move it further until it comes into contact with the cutting edge of the circular blade (1) and is cut. The yarn will thus be allowed to pass beyond the clamping element (13).

Figure 8:
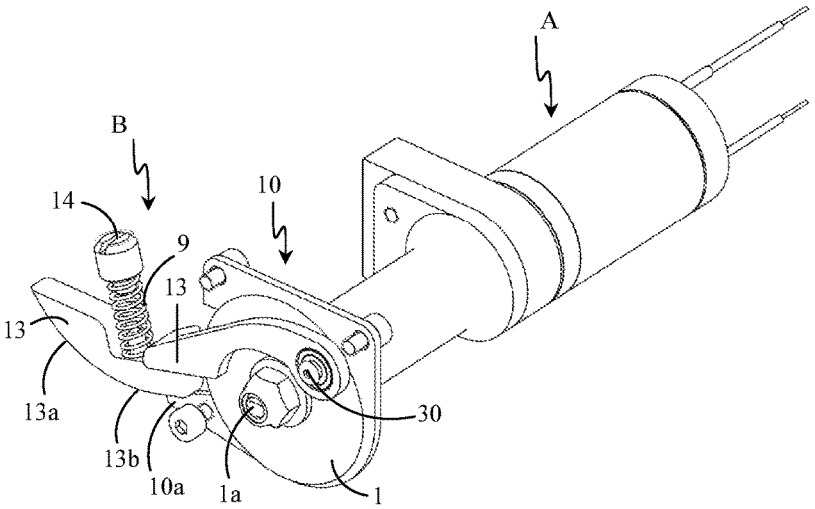
FIG. 8 shows a perspective view of this second embodiment, after removal of the housing on the side of the blade.

With the device illustrated in FIG. 8, the flank part (19) has been removed. The arm (8*b*) has thus also been removed here, as it forms part of this flank part (19).

In a preferred arrangement on a rapier weaving loom (see FIGS. 9A and 9B), a device according to the invention is arranged at an angle with respect to the closest fabric edge (20). There is preferably an acute angle (β) between the axis (21) of the device and a line (22) which runs parallel to the closest fabric edge (20) on the side facing away from the blade (1) (the top side in FIGS. 9A and 9B), preferably an angle of at most 45°, in which the device is tilted at said angle (β) towards the fabric edge (20) by the end which faces the rapier trajectory (23) and on which the blade (1) is provided, compared to a position parallel to the fabric edge and with the blade (1) facing the rapier trajectory (23).

The circular blade (1) is preferably in a plane (24) which is at an angle (not perpendicular) with respect to the fabric edge (20), and therefore also assumes an oblique position with respect to the motion trajectory (23) of the rapier (25). Preferably, there is an acute angle (γ) between the plane (24) of the blade and the motion trajectory (23) of the rapier (25) on the side facing the shed.

Figure 9A:
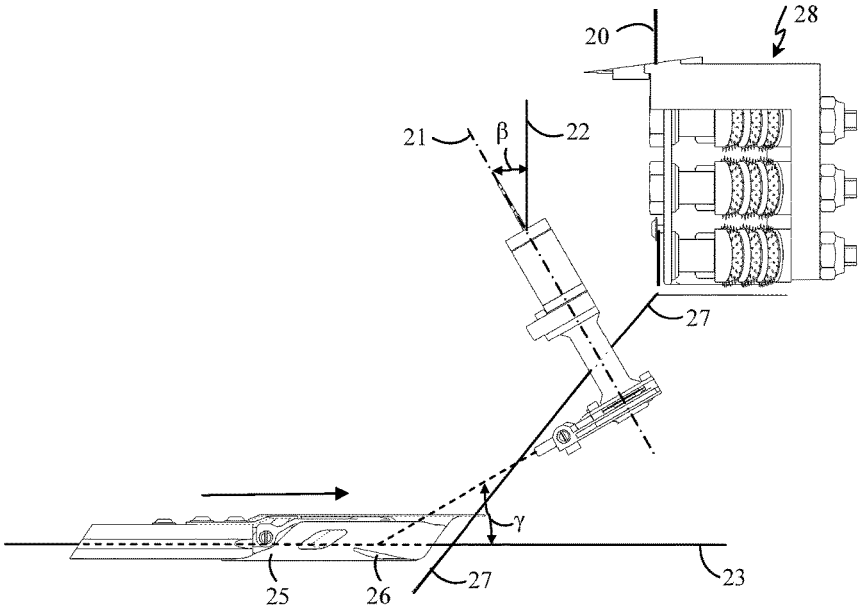
FIG. 9*a* shows a top view of a rapier during its movement towards the shed of a weaving loom, relative to a weft yarn extending between the fabric edge and the yarn stock, and a device arranged on the weaving loom for detaining and cutting off weft yarn according to the second embodiment, as illustrated in FIGS. 5 to 8.

FIG. 9A shows the first embodiment with a clamping element according to FIGS. 5 to 8. It goes without saying that the features of this arrangement are not limited to an arrangement of this first embodiment, but also apply to an arrangement of the second embodiment and generally for any possible embodiments within the scope of the present invention.

In FIG. 9A, the newly inserted weft yarn (27) which has been beaten up to the correct position against the fabric line by the weaving reed extends between the fabric edge (20) and the yarn stock (not shown). A giver rapier (25) moves towards the shed (to the right), and is shown in the position before reaching the weft yarn (27). A temple device (28) is provided along the fabric edge.

Figure 9B:
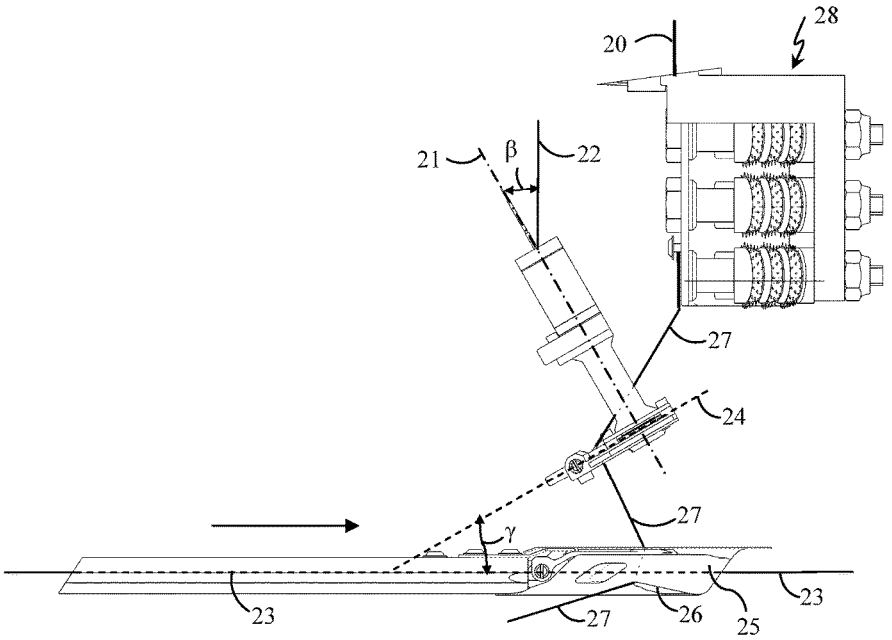
FIG. 9*b* shows a top view of FIG. 9*a* after further movement of the rapier in the direction of the shed, at the point in time when the weft yarn is detained by the detaining means.

In FIG. 9B, the same weaving loom is shown at the point in time when the rapier (25) has carried the yarn along to the detaining means, where it is clamped between the clamping element (13) and the guide surface (11). The yarn is detained by being clamped in, while the rapier (25) moves along. As a result thereof, the yarn (27) in FIG. 9B has arrived in the catch groove (26) of the rapier head and in the clamping means which are provided on the other side of the rapier (not shown in the figures). During the further movement of the rapier (25), an increasing tensile force will be exerted on the yarn (27). When a certain tensile force is exceeded, the clamping element (13) will rotate, counter to the spring force of the spring element (9), towards the non-detaining position and the yarn will be released, as a result of which it will be moved further by the rapier (25) until it comes into contact with the cutting face of the circular blade (1) and is cut. The yarn end of the yarn stock is situated in the abovementioned catch means (26) of the rapier (25) and is inserted in the shed by a next weft introduction.

The invention claimed is:

1. Device for cutting off a length of weft yarn inserted between warp threads during successive weaving cycles, comprising:

a cutting element to cut the yarn and a detaining device to detain the yarn during its movement towards the cutting element until the yarn is allowed to pass through in the direction of the cutting element as a result of a tensile force which is applied thereto, wherein the detaining device comprises a rotatable detaining element which is forced to a detaining position on account of a spring force which is exerted by a spring element, wherein the detaining element is provided to detain the yarn in its detaining position and, under the influence of a tensile force on the detained yarn, to rotate counter to said spring force to a non-detaining position in which the yarn can be moved further towards the cutting element in order to be cut.

2. Device according to claim 1 characterized in that the detaining device comprises a fixed guide element having a guide surface for the yarn facing the detaining element, so that the yarn can be detained while being in contact with the guide surface and the rotatable detaining element.

3. Device according to claim 1, characterized in that the detaining element is provided to prevent the movement of the yarn towards the cutting element without keeping the yarn clamped in.

4. Device according to claim 2, characterized in that the spring force exerted by the spring element is adjustable.

5. Device according to claim 2, characterized in that the detaining element comprises a yarn contact surface which faces away from the cutting device, and in that the yarn contact surface of the detaining element in the detaining position substantially extends in a direction which forms an angle with the guide surface which is between 45° and 135°.

6. Device according to claim 3, characterized in that the device comprises an additional guide element for guiding the yarn to a limited contact zone of the detaining element.

7. Device according to claim 3, characterized in that the detaining element is an elongate element which is forced to the detaining position by means of a torsion spring or itself forms part of a torsion spring.

8. Device according to claim 3, characterized in that it further comprises:

a guide element of which a free surface forms said guide surface, and an arm which extends opposite the guide element at an intermediate distance, wherein the cutting element is arranged in such a manner that a yarn can come into contact with the cutting element via the intermediate space between the guide element and the arm, wherein the detaining element is rotatably attached to the arm, so that it extends in the space between the arm and the guide element and prevents a yarn from passing to the cutting element, and wherein the spring element exerts a spring force on the detaining element and forces it to its detaining position, so that the detaining element, as a result of a tensile force on a yarn which is detained thereby, rotates in the direction of the cutting element in such a manner that the yarn is moved in the direction of the cutting element and comes into contact with the cutting element and is cut.

9. Device according to claim 2, characterized in that the detaining element comprises a clamping surface facing the guide surface, so that, in the detaining position, the detaining element can clamp the yarn between the clamping surface and the guide surface.

10. Device according to claim 9, characterized in that the position of the detaining element with respect to the guide surface is adjustable and/or in that the spring force exerted by the spring element is adjustable, in order to control the clamping force exerted on the yarn.

11. Device according to claim 10, characterized in that the clamping surface forms part of or changes into a convex curved surface.

12. Device according to claim 9, characterized in that it comprises:

an arm which extends opposite the guide element intermediate distance, wherein the guide element comprises a free surface forming said guide surface, wherein the cutting element is arranged in such a manner that a yarn can come into contact with the cutting element via the intermediate space between the guide element and the arm, wherein the detaining element with a clamping surface is rotatably attached, so that the detaining element is substantially situated between the guide element and the arm with the clamping surface facing the guide surface, and wherein the spring element on one side acts on the arm and, on the other side, acts on the detaining element and pushes the detaining element towards the guide element to keep a yarn clamped between the guide surface and the clamping surface and thus to prevent the movement of said yarn towards the cutting element, in which a tensile force on the yarn clamped in this way can cause the detaining element to rotate away from the guide surface in such a manner that the yarn is released and is moved further to the cutting element and cut.

13. Device according to claim 1, characterized in that said cutting element is a rotatable circular blade.

14. Device according to claim 1, characterized in that said cutting element is substantially covered by a covering wall and/or a housing on at least one side.

15. Weft-insertion device for a weaving loom, comprising at least one rapier which is provided to insert a weft thread in successive weaving cycles in a shed formed between warp threads, wherein said weft-insertion device comprises a device according to claim 1.

16. Weft-insertion device for a weaving loom, according to claim 15, characterized in that the rapier comprises pick-up means in order to carry along a weft yarn to the shed, wherein the rapier is provided to carry along a yarn which extends between the fabric edge and the weft yarn stock to the shed and take the yarn to the detaining device during this movement, so that the yarn is detained and hereby pulled into the catch means of the rapier which is moving along.

17. Weft-insertion device for a weaving loom according to claim 15, characterized in that the rapier is provided to carry along the yarn detained by the detaining device during its movement to the shed, so that a tensile force is exerted on the detained yarn which causes the detaining element to rotate to a non-detaining position, as a result of which the yarn can be moved further towards the cutting element and can come into contact with the cutting element and is cut.

18. Weft-insertion device for a weaving loom according to claim 15, characterized in that it comprises at least two rapiers which are provided to insert a weft thread in successive weaving cycles at respective weft-insertion levels in a shed between warp threads, characterized in that a device according to claim 1 is provided for each rapier.

19. Double-face weaving loom characterized in that it comprises a weft-insertion device according to claim 18.

* * * * *